United States Patent [19]

Covington

[11] Patent Number: 4,625,674

[45] Date of Patent: Dec. 2, 1986

[54] GUNNEL FLOTATION PIPE AND METHOD OF INSTALLATION

[76] Inventor: Jack B. Covington, 407 W. 1st North, Rexburg, Id. 83440

[21] Appl. No.: 634,608

[22] Filed: Jul. 26, 1984

[51] Int. Cl.[4] ..... B63B 43/14

[52] U.S. Cl. ..... 114/360; 114/123; 114/356; 228/182; 228/212

[58] Field of Search ..... 114/123, 356, 359, 360, 114/79 R, 79 W, 81; 228/182, 184, 212; 29/449, 452, 457

[56] References Cited

U.S. PATENT DOCUMENTS

| | | | |
|---|---|---|---|
| 1,220,876 | 3/1917 | Moore | 114/360 |
| 1,335,072 | 3/1920 | Nichols | 114/356 |
| 1,417,824 | 5/1922 | Haack | 114/123 |
| 1,549,251 | 8/1925 | Geyer | 228/182 |
| 2,370,508 | 2/1945 | Wilkie | 114/79 W |
| 3,221,351 | 12/1965 | Keller | 114/63 |
| 4,060,864 | 12/1977 | Woolworth | 114/356 |

*Primary Examiner*—Galen L. Barefoot
*Assistant Examiner*—Thomas J. Brahan
*Attorney, Agent, or Firm*—Harvey B. Jacobson

[57] ABSTRACT

An aluminum boat is provided including laterally outwardly bowed gunnels and each of the gunnels has an outer side tubular aluminum flotation member extending therealong, bowed to conform to and welded to the outer side surface of the gunnel. The opposite ends of each tubular flotation member are sealingly closed and the interior of the tubular member is occupied by non-liquid absorbing lightweight flotation material. The tubular flotation member is secured to the corresponding gunnel by first tack-welding one end of the tubular member to a generally straight rear portion of the gunnel and then yieldingly biasing the forward end of the tubular flotation member laterally inwardly while effecting localized heat to the tubular member in the area in which it diverges outwardly from the bowed portion of the gunnel to thereby reshape the tubular member to conform to the bowed area of the gunnel and enable the bent portion of the flotation member to be welded to the gunnel bowed portion. After installation the interior of the tubular member may be filled with non-liquid absorbent lightweight flotation material and the ends of the tubular members may be sealed closed.

3 Claims, 6 Drawing Figures

GUNNEL FLOTATION PIPE AND METHOD OF INSTALLATION

BACKGROUND OF THE INVENTION

Many different types of boats are constructed of aluminum and include various forms of flotation to prevent such boats from sinking in the event they become swamped. For example, aluminum runabouts with deep-V hulls or modified-V hulls usually are equipped with floorboards beneath which foam flotation is placed. In addition, other forms of aluminum boats include various out-of-the-way areas in which foam flotation may be placed.

Even some aluminum John boats are constructed with downwardly opening inverted channel-shaped seats in which foam flotation is installed. However, other small fishing boats and John boats are manufactured without flotation and sink when capsized. A small John boat may be provided with under seat foam flotation, but such foam flotation occupies variable storage space for tackle boxes and the like which otherwise would occupy floor space on a small John boat used for fishing and therefore interfere with movements of fishermen within the boat. Accordingly, a need exists for a new means of providing ample flotation for a small fishing boat such as a small John boat, independent of utilizing under seat areas for such flotation.

Examples of boat flotation devices including some of the general structural and operational features of the instant invention as well as other remotely similar structures and methods involved in providing the flotation are disclosed in U.S. Pat. Nos. 151,400, 1,220,876, 1,238,185, 1,249,633, 1,701,874, 3,764,174 and 3,939,553.

BRIEF DESCRIPTION OF THE INVENTION

A pair of tubular aluminum flotation structures are provided and are disposed along, bent to conform to the shape of and are welded to the opposite side outwardly bowing gunnels of a lightweight aluminum fishing boat. The opposite ends of the flotation structures are closed in a fluid-tight manner so as to define sealed flotation chambers within the tubular members and the interiors of the tubular members may be filled with non-water absorbent foam flotation material, if desired.

The tubular flotation members secured along the gunnels of a John boat equipped with sharply inwardly directed and forwardly convergent bow rails may incorporate additional tubular members extending along the bow rails, joined at their remote ends to the front ends of the gunnel tubular members and joined in a fluid-tight manner at their adjacent ends. These tubular members may also contain flotation material and the gunnel tubular members are initially tack-welded at their rear ends to the rear ends of the corresponding gunnels and, with the forward ends of the tubular members projecting forwardly of the corresponding gunnels, the forward ends of the tubular members are progressively pulled together and successive forwardly spaced portions of the tubular members are welded to the bowed gunnel portions after moderate heat is applied to the tubular members in the areas thereof requiring to be bent in order to conform to the bowed configuration of the corresponding gunnels.

As successive forward spaced portions of the tubular members are heated and tack-welded to the opposing gunnel portions the forward ends of the tubular members are pulled further together.

By gradually heating and flexing the forward ends of the tubular members inwardly the latter are conformed to the bowed shape of the opposing gunnels and may be progressively welded in place. The heat utilized to heat the tubular members may be termed moderate heat and is most certainly below the temperature at which the aluminum of which the tubular members are constructed melts.

The main object of this invention is to provide an apparatus and method for rendering a non-flotation equipped aluminum boat buoyant, even when capsized.

Another object of this invention is to provide a flotation system utilizing readily available aluminum components for support from the aluminum gunnels of a lightweight fishing boat.

A further important object of this invention is to provide a method of simultaneously shaping and securing straight aluminum tubular members along outwardly bowed gunnel portions of an aluminum boat.

A further object of this invention is to provide flotation for lightweight aluminum fishing boats and the like not originally provided with flotation and in a manner offering considerable strength reinforcement to the gunnels of the associated lightweight fishing boat.

A final object of this invention to be specifically enumerated herein is to provide a flotation system for lightweight aluminum fishing boats in accordance with the preceding objects and which will conform to conventional forms of manufacture, by of simple construction and easy to install so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
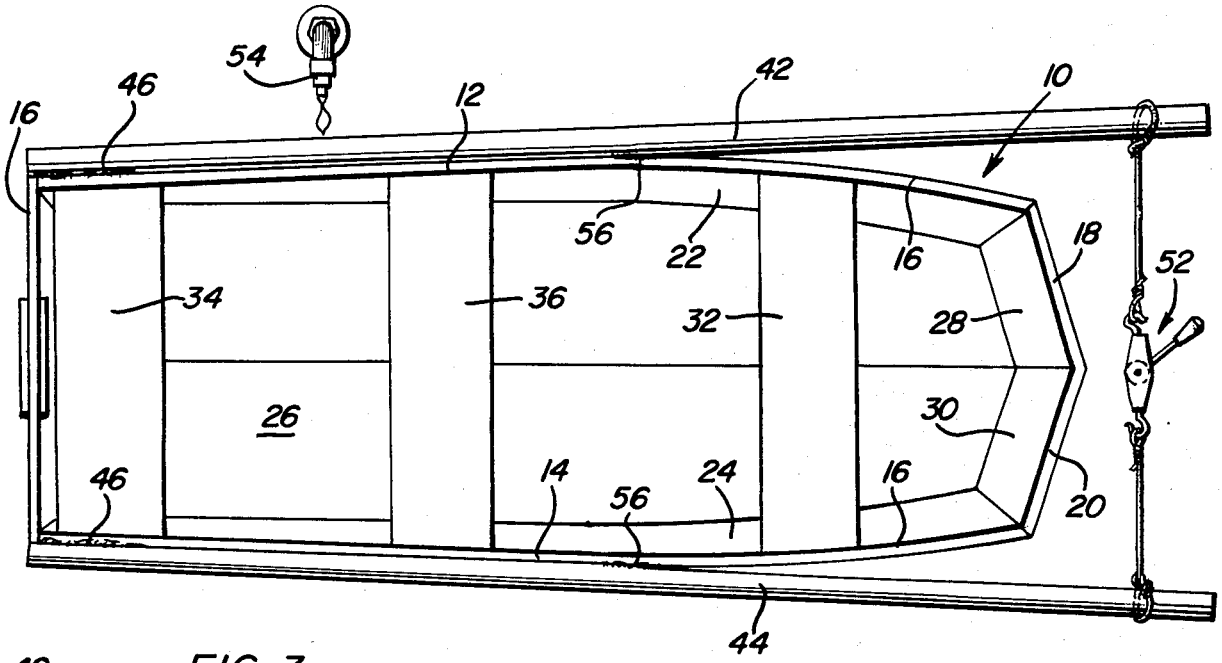
FIG. 1 is a top plan view of a typical form of lightweight fishing boat and with a pair of aluminum tubular members in position extending along opposite gunnels of the boat and as partially mounted on the boat gunnels.
Figure 3:
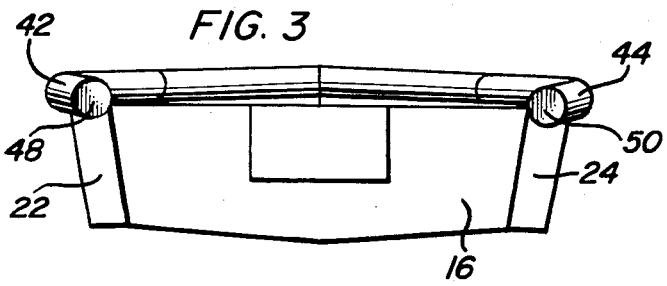
FIG. 3 is a reduced rear elevational view of the boat with the flotation assembly fully mounted thereon.
Figure 5:
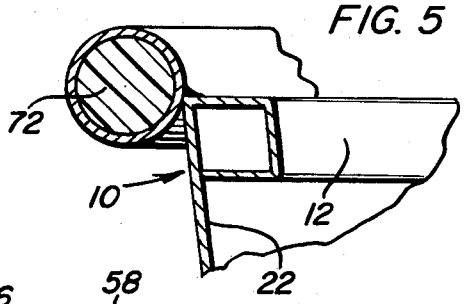
FIG. 5 is an enlarged fragmentary transverse vertical sectional view illustrating the manner in which one of the tubular members may be filled with foam flotation.

Referring now more specifically to the drawings the numeral 10 generally designates a lightweight aluminum fishing boat including opposite side gunnels 12 and 14 including forward end portions 16 and 18 which curve inwardly toward and are joined to sharply inwardly directed opposite side bow rails 18 and 20. The boat 10 includes opposite sides 22 and 24 interconnected at their rear marginal portions by a transverse transom 16 and along whose upper marginal edges the gunnels 12 and 14 extend. In addition, the boat 10 includes a bottom 26 extending between the lower marginal edges of the sides 22 and 24 and forward bow panels 28 and 30 extending between the bow rails 18 and 20, the forward marginal portions of the sides 22 and 24 and the opposite side front marginal portions of the bottom 26. In addition, the boat 10 includes front, rear and intermediate position transverse seats 32, 34 and 36, all of the above referred to structure of the boat 10 being considered as conventional.

Although in some instances the seats 32, 34 and 36 are in the form of downwardly opening channel members constructed of sheet metal and these channel members may receive blocks of foam flotation, such foam flotation is not always provided and in some cases extends from the underside of the subject seats to the floor 26 and thereby occupies valuable storage space beneath the seats 32, 34 and 36.

In order to provide ample flotation for the boat 10 even when the gunnels 12 and 14 are awash as if the boat has been scuttled, a pair of elongated longitudinally straight tubular members 42 and 44 are positioned along the gunnels 12 and 14 with the rear ends of the tubular members 42 welded in position as at 46. The rear ends of the tubular members 42 and 44 have end plates 48 and 50 secured thereover in a fluid-tight manner and in order to form the tubular members 42 and 44 to the bowed configuration of the forward ends of the gunnels 12 and 14 any suitable pull structure such as a winch assembly 52 is connected between the forward ends of the tubular members 42 and tensioned so as to slightly bow the tubular members 42 and 44.

Figure 2:
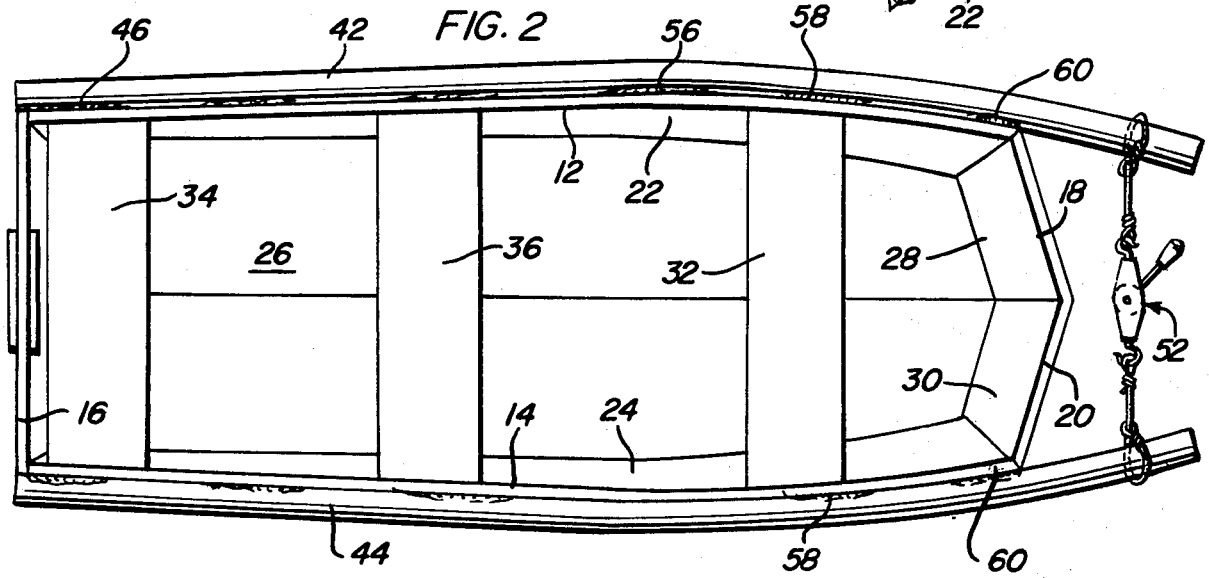
FIG. 2 is a further top plan view similar to FIG. 1 but illustrating the tubular flotation members in a further installed condition on the boat.
Figure 4:
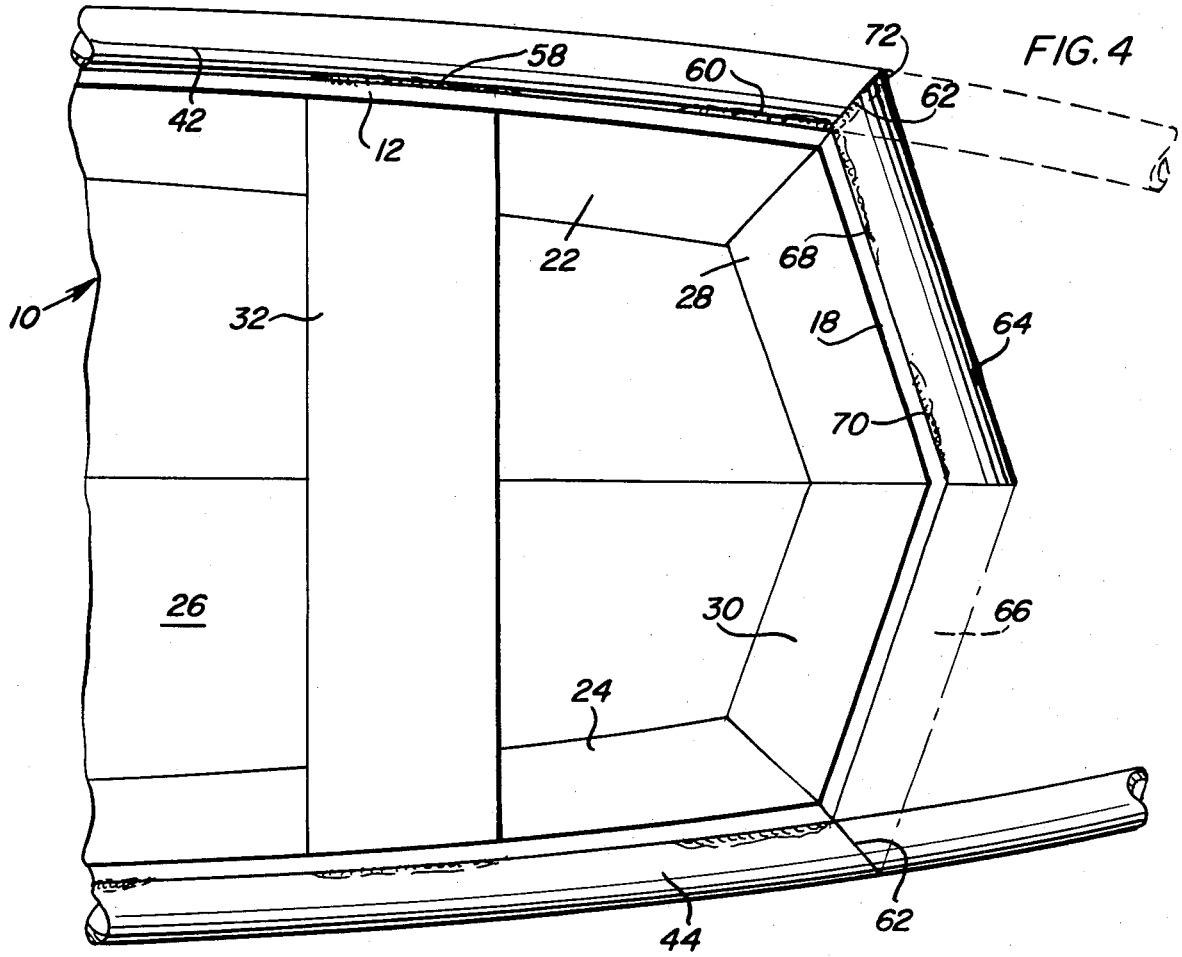
FIG. 4 is an enlarged plan view of the bow end of the boat illustrating the manner in which the forward ends of the tubular members are joined by inwardly directed short tubular member sections extending and secured along the forwardly convergent bow rails of the boat.

The gunnels 12 and 24 are constructed of aluminum, as are the tubular members 42 and 44, and the slightly bowed portions of the tubular members 42 and 44 have medium heat applied thereto by any suitable heat source such as a torch 54. As the tubular members 42 and 44 are heated to medium temperatures they bend slightly and take a set to conform to the curvature of the forward ends of the gunnels 12 and 14 and are further welded in place as at 56. The, the tension on the winch assembly 52 is increased and further forward portions of the tubular members 42 and 44 are heated by the torch 54 until they abut the opposing gunnel portions to which they are then secured by welding as at 58. Finally, the winch assembly 52 is further tightened as illustrated in FIG. 2 and the forward end portions of the tubular members 42 and 44 are heated through utilization of the torch 54 and finally welded in position as at 60.

Thereafter, the forward ends of the tubular members 42 and 44 are cut at an angle as at 62 and short tubular member sections 64 and 66 are cut to fit to extend along the bow rails 18 and 20 and are secured as at 68 and 70 to the bow rails. Thereafter, the abutting ends of the sections 64 and 66 and the tubular members 42 may be welded together as at 72 to form a fluid-tight seal therebetween.

The interiors of the tubular members 42 and 44 may be filled with lightweight foam flotation 72 as may the sections 64 and 66. The foam flotation 72 may be formed in situ by the spraying of foam material producing chemicals into the interior of the tubular members 42 and 44 through appropriate openings (not shown) formed therethrough. Such openings may also be used to pressure test the tubular members 42 and 44 as well as the sections 18 and 20 to determine whether or not they are airtight. After such a pressure test has been made, the aforementioned openings may be suitably closed.

Figure 6:
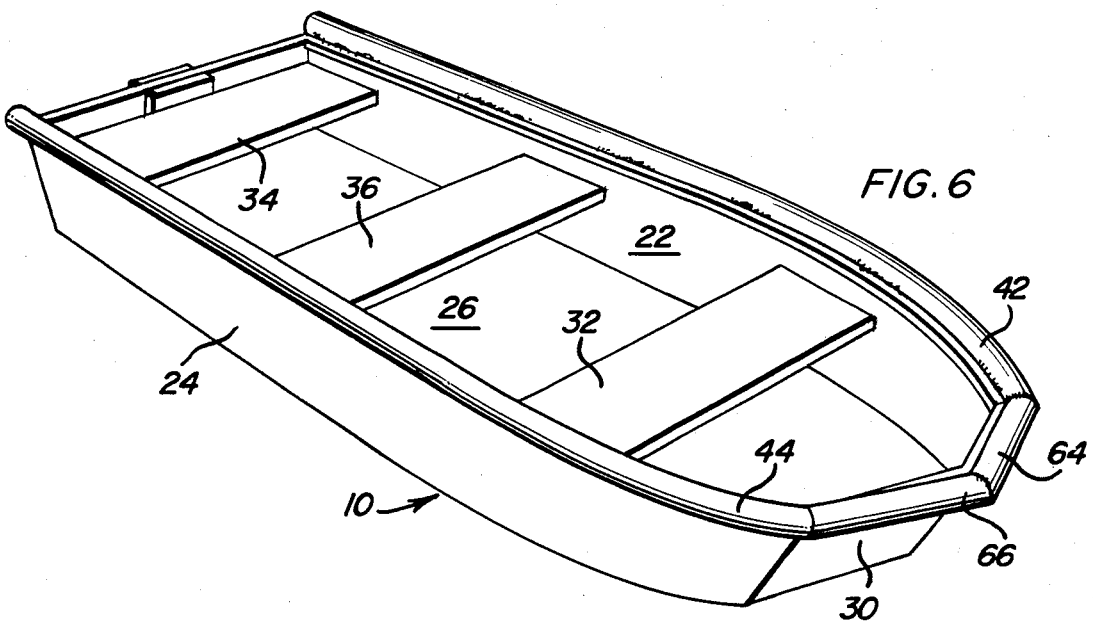
FIG. 6 is a perspective view of the completed flotation-equipped lightweight aluminum fishing boat.

FIG. 6 of the drawings illustrates the flotation system of the instant invention as fully mounted on the boat 10 and as operational to provide ample flotation for the boat 10, even though the gunnels 12 and 14 may be awash. The tubular members 42 and 44, together with the sections 18 and 20, not only form ample flotation for the boat 10, but also serve to provide substantial reinforcement for the gunnels 12 and 14. This enables the boat 10 to be used in conjunction with an outboard motor of somewhat higher rating than the boat may have been certified for and the tubular members 42 and 44 as well as the sections 18 and 20 also function as fender structures.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. The method of stiffening and providing flotation for an outwardly bowed aluminum gunnel of a boat, said method comprising:

A. placing a generally longitudinally straight aluminum tubular member along said gunnel with one end portion of said tubular member abutted against the outer side of one end portion of said gunnel and the other end portion of said tubular member tangent to the adjacent portion of the inwardly curving other end portion of said gunnel;

B. welding said one end portions to each other;

C. applying a moderate inward thrust on said tubular member other end portion sufficient to flex said tubular member into a configuration with a mid-portion thereof conforming to the curvature of at least the adjacent areas of the inwardly curving other end portion of said gunnel, but with less thrust than that which will flex said tubular member past the flexure limit thereof;

D. applying moderate heat along the flexed portion of said tubular member to allow the flexure stresses thereon to effect a permanent gradual bend or set in said tubular member to thereby allow a further length portion of said tubular member to abut and extend along said inwardly curving other end portion of said gunnel;

E. welding said flexed and heated further length portion of said tubular member to the opposing gunnel outer surfaces;

F. repeating steps C, D and E until substantially the full length of said gunnel has opposing portions of said tubular member welded thereto;

G. rendering said tubular member buoyant.

2. The method of claim 1 wherein step G includes at least substantially filling the interior of said tubular member with a non-water abosrbent flotation material.

3. The method of claim 1 wherein step G includes sealingly closing said tubular member ends.

* * * * *